US009790783B2

(12) United States Patent
Brown-Kerr et al.

(10) Patent No.: US 9,790,783 B2
(45) Date of Patent: Oct. 17, 2017

(54) DETERMINING THE DEPTH AND ORIENTATION OF A FEATURE IN A WELLBORE

(71) Applicant: Halliburton Manufacturing and Services Limited, Surrey (GB)

(72) Inventors: William Brown-Kerr, Aboyne (GB); Bruce Hermann Forsyth McGarian, Stonehaven (GB)

(73) Assignee: HALLIBURTON MANUFACTURING AND SERVICES LIMITED, Leatherhead, Surrey (GB)

( * ) Notice: Subject to any disclaimer, the term of this patent is extended or adjusted under 35 U.S.C. 154(b) by 231 days.

(21) Appl. No.: 14/382,120

(22) PCT Filed: Apr. 24, 2013

(86) PCT No.: PCT/GB2013/051029
§ 371 (c)(1),
(2) Date: Aug. 29, 2014

(87) PCT Pub. No.: WO2013/164570
PCT Pub. Date: Nov. 7, 2013

(65) Prior Publication Data

US 2015/0096747 A1 Apr. 9, 2015

(30) Foreign Application Priority Data

Apr. 30, 2012 (GB) ..... 1207527.1

(51) Int. Cl.

| | |
|---|---|
| ***E21B 47/09*** | (2012.01) |
| ***E21B 47/026*** | (2006.01) |
| ***E21B 47/04*** | (2012.01) |
| ***E21B 47/12*** | (2012.01) |

(52) U.S. Cl.
CPC ..... *E21B 47/0905* (2013.01); *E21B 47/026* (2013.01); *E21B 47/04* (2013.01); *E21B 47/12* (2013.01)

(58) Field of Classification Search
USPC ..... 166/254.1, 66
See application file for complete search history.

(56) References Cited

U.S. PATENT DOCUMENTS

| | | | | |
|---|---|---|---|---|
| 4,673,890 | A | 6/1987 | Copland et al. | |
| 2004/0262006 | A1* | 12/2004 | Dewey | E21B 17/07 166/313 |

(Continued)

FOREIGN PATENT DOCUMENTS

| | | |
|---|---|---|
| GB | 2332008 A | 6/1999 |
| GB | 2422622 A | 8/2006 |

(Continued)

OTHER PUBLICATIONS

Official Action for Canadian Patent Application No. 2,870,818 dated Jan. 12, 2016.

(Continued)

*Primary Examiner* — Taras P Bemko
(74) *Attorney, Agent, or Firm* — McDermott Will & Emery, LLP

(57) ABSTRACT

The invention relates to a device for determining the depth and orientation of a feature in a wellbore, and to a corresponding method. It also relates to a downhole apparatus for performing an operation in a well comprising a device for determining the depth and orientation of a feature in a wellbore and a device for performing the operation. In an embodiment, a downhole device (42) for determining the depth and orientation of a feature (24, 26, 28) in a wellbore (12) containing a ferrous tubing (14) is disclosed, the device comprising: at least one magnetic field sensor (44) for monitoring the inherent magnetic field of the ferrous tubing (Continued)

so that the presence of the feature can be detected; and at least one orientation sensor (48) for determining the orientation of the device within the wellbore. An output from the at least one magnetic field sensor is correlated with an output from the at least one orientation sensor so that the orientation of the feature detected by the at least one magnetic field sensor within the wellbore can be determined.

19 Claims, 10 Drawing Sheets

(56) References Cited

U.S. PATENT DOCUMENTS

| | | | |
|---|---|---|---|
| 2006/0006000 | A1 | 1/2006 | Weston et al. |
| 2009/0166035 | A1 | 7/2009 | Almaguer |

FOREIGN PATENT DOCUMENTS

| | | | | | |
|---|---|---|---|---|---|
| GB | WO 2007015087 | A1 * | 2/2007 | ..... | E21B 47/0905 |
| GB | 2481493 | A | 12/2011 | | |
| WO | 2011004180 | A2 | 1/2011 | | |
| WO | 2013164570 | A2 | 11/2013 | | |

OTHER PUBLICATIONS

International Search Report and Written Opinion for PCT/GB2013/51029 dated Dec. 20, 2013.

* cited by examiner

DETERMINING THE DEPTH AND ORIENTATION OF A FEATURE IN A WELLBORE

The present invention relates to a device for determining the depth and orientation of a feature in a wellbore, and to a corresponding method. The present invention also relates to a downhole apparatus for performing an operation in a well comprising a device for determining the depth and orientation of a feature in a wellbore and a device for performing the operation. In particular, but not exclusively, the present invention relates to a device for determining the depth and orientation of a feature in a wellbore which employs at least one magnetic sensor.

In the oil and gas exploration and production industry, a wellbore is drilled from surface and lined with wellbore-lining tubing known as casing. The wellbore may be many thousands of feet in length. The casing performs a number of functions, including supporting the drilled rock formations and providing a conduit for the passage of fluid, tools and tubing into and out of the wellbore. During the drilling and completion of a well, and indeed following completion such as in an intervention procedure, it is frequently necessary to introduce a tool or tubing into the well to perform a particular function. This normally requires the tool or tubing to be positioned at a precise depth in the well, and/or at a particular orientation or 'azimuth'. The azimuth of the tool or tubing is its rotational position within the well relative to north on a compass.

One situation where this is very important is in a multilateral well. This is a well in which a main wellbore or borehole is drilled from surface, and one or more lateral wellbores are drilled, branching off from the main wellbore. The lateral wellbores extend from the main wellbore into one or more wells which are laterally displaced from the main wellbore. The lateral wellbore is drilled from the main wellbore by milling a feature known as a 'window' in the wall of the casing located in the main wellbore. The window is typically formed using a whipstock assembly, which is located at the required depth and orientated so at to laterally deflect a milling tool from the main wellbore into the surrounding formation. The lateral wellbore is then lined with wellbore-lining tubing known as a liner, which extends back to the casing in the main wellbore.

The depth and orientation of the window in the tubing is generally known. It may be necessary to subsequently re-enter the lateral, for example to perform a treatment or stimulation operation on the lateral well, or to place a straddle packer in the lateral liner to pack off a portion of the lateral, or indeed to close off the lateral. The latter may be necessary where the lateral well has started to produce water. These procedures require downhole equipment to be positioned at the depth of the window in the main wellbore casing, and at the correct orientation, in order for mechanical deflection of further equipment into the lateral wellbore.

Situations can arise where the depth and orientation of the window is not well known, making this procedure difficult. Furthermore, there may be multiple windows in the main wellbore casing, which are often closely spaced. Correct identification of the relevant window is critical for the wellbore operation which is to be carried out. Insertion and setting of downhole equipment in the wrong lateral can be extremely expensive, both in terms of lost time and even complete loss of production from a lateral.

Similar problems can exist when trying to locate other types of downhole features in a wellbore. Such features might include a latch profile or recess in the wall of a wellbore tubular.

In the past, mechanical devices have been employed to locate downhole features, such as a window in a casing. The devices typically comprise some form of engaging member which can project into the window, for determining that the window has been reached. However, this does not address the problem of correctly identifying one window among a number of closely spaced windows, which may be located many thousands of feet below the surface. Also, the tools do not provide any indication of orientation of the window.

The surfaces of elongate, ferrous fluid pipelines have been investigated for anomalies using induced magnetic fields. Devices of this type are known as 'pipeline pigs', and are typically intended to detect anomalies such as small cracks in the ferrous pipeline. The devices generate a large magnetic field, and then monitor the remnant fields to determine whether any cracks exist. The devices have high power requirements, and so require large power sources. As such, they are not suitable for downhole use. In addition, the devices do not provide any indication of rotational orientation within the pipeline, and so no data on rotational orientation of the anomaly.

Casing collar locators (CCLs) have been employed for detecting the presence of casing collars in a wellbore which has been lined with a ferrous casing, the collars coupling two sections of casing together end to end. The CCL provides an indication of the depth of the casing collar which is located when the CCL is run through the wellbore. However, CCLs do not provide any indication of orientation. Also, more recent casings do not employ casing collars, and so CCLs are not effective in such situations.

It is amongst the objects of the present invention to obviate or mitigate at least one of the foregoing disadvantages.

According to a first aspect of the present invention, there is provided a downhole device for determining the depth and orientation of a feature in a wellbore containing a ferrous tubing, the device comprising:

- at least one magnetic field sensor for monitoring the inherent magnetic field of the ferrous tubing so that the presence of the feature can be detected; and
- at least one orientation sensor for determining the orientation of the device within the wellbore;
- in which an output from the at least one magnetic field sensor can be correlated with an output from the at least one orientation sensor so that the orientation of the feature detected by the at least one magnetic field sensor within the wellbore can be determined.

The present invention offers advantages over prior devices in that it facilitates determination of both a depth and orientation (azimuth) of a feature in a wellbore. This enables precise location of the feature so that a subsequent downhole operation can be carried out. For example, the feature may be a window formed in a wellbore-lining tubing located in a main wellbore, and which provides access to a lateral well. The window may be one of a plurality of such windows spaced apart along a length of the main wellbore and optionally at different orientations (azimuths). The invention may facilitate accurate location of one of the windows.

The invention may also offer advantages over prior devices employing magnetic sensors, in that it comprises at least one magnetic field sensor which can monitor the inherent magnetic field of the ferrous tubing, rather than generating a magnetic field which is then employed to interrogate the tubing. Power requirements for the device are thus lower than in prior devices, and are suited to a downhole use.

The at least one magnetic field sensor may be a passive magnetic field sensor, and may comprise a coil. An electrical current is induced in the coil when it is moved through the inherent magnetic field of the ferrous tubing.

The device may comprise a plurality of magnetic field sensors. The magnetic field sensors may be spaced around a periphery of the device. This may facilitate detection of the feature and/or determination of the shape of the feature. At least one magnetic field sensor may be spaced axially along a length of the device from at least one other sensor. The magnetic field sensors may be provided in an array extending around a periphery of the device, which array may extend around the entire periphery of the device. The device may comprise a plurality of arrays of magnetic field sensors, each array comprising a plurality of magnetic field sensors. Each array may be spaced axially along a length of the device from at least one other array. Each array may be spaced around a periphery of the device from at least one other array.

The device may comprise at least one sensor for measuring inclination, which may be an inclinometer. This may facilitate determination that a lateral wellbore has been correctly entered, in that feedback on the inclination of the wellbore (which is known) can be obtained. The at least one orientation sensor may be or may comprise a magnetometer or a gyroscope. The device may comprise a plurality of inclination sensors and/or orientation sensors.

The ferrous tubing may be one of a range of different types of tubing employed in the oil and gas exploration industry and which can be deployed downhole in a wellbore, and which may comprise but is not limited to wellbore-lining tubing (casing, liner), coiled tubing, production tubing, and a string of tubing for deploying a tool or assembly in a well.

The feature may be a profile in the wellbore, which may be formed in the ferrous tubing or in a separate item coupled to the ferrous tubing. The profile may be a window formed in the ferrous tubing, which may be a window of a lateral well. The profile may be a recess, groove or channel formed in an internal wall of the ferrous tubing, which may be a latch profile for receiving a latch element that is to be engaged with the latch profile. The feature may be a body having an inherent magnetic field which is less than that of a material of the ferrous tubing, or which may be non-ferrous or non-magnetic, or which may have a negligible inherent magnetic field. The body may be a tubular component and may be a sleeve or the like positioned within and/or coupled to the ferrous tubing.

Correlation of the output from the at least one magnetic field sensor with that of the at least one orientation sensor may facilitate the determination of data about the shape of the feature. For example, where the feature is a profile such as a window, a circumferential width of the window will typically change along a length of the wellbore. The device may facilitate the determination of the shape of the window in that it is capable of distinguishing the change in circumferential width, owing to the changes in the quantity of ferrous material detected.

The at least one magnetic field sensor may be oriented relative to a datum on the device, which may be a scribe line. The device may be deployed into the wellbore in such a way that the orientation of the datum relative to north on a compass is known. In this way, the orientation of a feature whose presence is detected by the at least one magnetic field sensor can be determined, because the orientation of the sensor relative to the datum is known, and the orientation of the datum relative to north on a compass is known. Where the device is to be deployed into a deviated wellbore, the device may be deployed in such a way that the datum is aligned with a high side of the wellbore. The high side is the portion of the deviated wellbore which is closer to the surface. The part of the device carrying the datum may be known as the tool-face.

The device may comprise a processor for correlating the output from the at least one magnetic field sensor with the output from the at least one orientation sensor. The processor may be pre-programmed with data relating to the orientation of the datum on the device relative to north on a compass, so that the outputs from the magnetic field and orientation sensors can be correlated. The processor may be arranged to transmit data relating to the depth and orientation of the feature to surface. Alternatively, the device may be arranged to transmit data relating to the outputs to a processor provided at surface.

The device may be deployable in the well on a string of tubing, wireline or slickline. Deployment on tubing may be preferred as this may facilitate use in a deviated well. Where there are a plurality of magnetic field sensors, the processor may receive outputs from all of the sensors. By correlating the output of a particular magnetic field sensor with the output of the at least one orientation sensor, a determination of the orientation of the feature detected by the magnetic field sensor (and to which the output pertains) can be achieved.

The device may comprise a communication arrangement for transmitting data to surface, which data may relate to the depth and/or orientation of a feature. The communication arrangement may be capable of transmitting data to surface real-time. This may provide feedback relating to the position of the device within the wellbore, and so the depth and orientation of the feature, which may facilitate subsequent performance of a downhole operation. The communication arrangement may be fluid operated and may be a fluid pulse generator for transmitting fluid pressure pulses representative of the data to surface. One such suitable device is disclosed in the present applicant's International Patent Publication No. WO-2011/004180, the disclosure of which is incorporated herein by way of reference. The communication arrangement may be electrically operated, and may transmit data to surface along a communication cable extending to surface, along the ferrous tubing or another tubing in the wellbore. Other communication arrangements may be employed, such as acoustic or radio frequency communication arrangements.

The depth of the device in the wellbore will generally be known however the device is deployed into the well, as the length of the tubing, wireline or slickline deployed into the well will be known. The depth of a feature detected by the at least one magnetic field sensor can therefore be determined by correlating the length of tubing, wireline or slickline deployed into the wellbore with data relating to the detection of the feature. Reference is made herein to the depth of the device and the feature in the wellbore. It will be understood that such references are to the distance of the device/feature along the wellbore from surface, bearing in mind that the wellbore may be deviated from the vertical and so vertical depth may differ from distance along the wellbore from surface.

According to a second aspect of the present invention, there is provided a downhole apparatus for performing an operation in a well, the apparatus comprising:

a device for determining the depth and orientation of a feature in a wellbore containing a ferrous tubing; and a device for performing an operation in the well which is arranged to cooperate with the feature;

in which the device for determining the depth and orientation of the feature comprises:

at least one magnetic field sensor for monitoring the inherent magnetic field of the ferrous tubing so that the presence of the feature can be detected; and at least one orientation sensor for determining the orientation of the device within the wellbore;

in which an output from the at least one magnetic field sensor can be correlated with an output from the at least one orientation sensor so that the orientation of the feature detected by the at least one magnetic field sensor within the wellbore can be determined;

and in which, following determination of the depth and orientation of the feature, the downhole operation can be carried out.

The invention may facilitate determination of the depth and orientation of the feature in a single run with the device for performing the downhole operation. In other words, the invention facilitates determination of the depth and orientation of the feature, followed by performance of the downhole operation, in a single run of equipment (the device for determining the depth and orientation of the feature and the device for performing the operation in the well), and/or without requiring that the device for determining the depth and orientation of the feature be removed from the wellbore before the downhole operation can be performed.

Further features of the device for determining the depth and orientation of the feature in the wellbore are defined above in relation to the first aspect of the invention.

The downhole operation may be any downhole operation which requires knowledge of a depth and/or orientation of a feature within a wellbore in order that the operation can be performed. The invention has a particular utility, however, in determining the depth and orientation of a feature in the form of a profile in the wellbore, which the device for performing the operation cooperates with in order to perform the operation. For example, the feature may be a profile in the form of a window formed in a wellbore-lining tubing located in a main wellbore, and which provides access to a lateral well. The window may be one of a plurality of such windows spaced apart along a length of the main wellbore and optionally at different orientations (azimuths). The invention may facilitate accurate location of one of the windows and subsequent entry into the lateral through the window so that the downhole operation can be performed. The downhole operation may be the insertion of a straddle in the lateral wellbore for isolating a portion of the lateral wellbore, the insertion of a packer into the lateral wellbore for closing off the wellbore, or the performance of a stimulation operation on the lateral well such as by the injection of a treatment fluid. Alternatively, the profile may be a recess, groove or channel formed in an internal wall of the ferrous tubing, which may be a latch profile for receiving a latch element that is to engage the profile. The device for performing the downhole operation may cooperate with the profile by latching into the profile so that the downhole operation may be performed. The downhole operation may involve the location of a component within the ferrous tubing, which may be any one of a wide range of downhole components.

The feature may be a body having an inherent magnetic field which is less than that of a material of the ferrous tubing, or which may be non-ferrous or non-magnetic, or which may have a negligible inherent magnetic field. The body may be a tubular component and may be a pipe, tube, sleeve or the like positioned within and/or coupled to the ferrous tubing.

According to a third aspect of the present invention, there is provided a method of determining the depth and orientation of a feature in a wellbore containing a ferrous tubing, the method comprising the steps of:

running a downhole device comprising at least one magnetic field sensor through the ferrous tubing and monitoring the inherent magnetic field of the ferrous tubing using the at least one magnetic field sensor to detect the presence of the feature;

determining the orientation of the device within the wellbore using at least one orientation sensor of the downhole device; and determining the orientation of the feature detected by the at least one magnetic field sensor within the wellbore by correlating an output from the at least one magnetic field sensor with an output from the at least one orientation sensor.

The method may comprise determining the shape of the feature. The feature may be a profile in the wellbore. The profile may be a window formed in the ferrous tubing, which may be a window of a lateral well. Correlation of the output from the at least one magnetic field sensor with that of the at least one orientation sensor may facilitate the determination of data about the shape of the feature. For example, where the feature is a profile such as a window, a circumferential width of the window will typically change along a length of the wellbore. The method may involve determination of the shape of the window by assessing the change in circumferential width of the window, by monitoring changes in the quantity of ferrous material as the device passes along the wellbore.

The at least one magnetic field sensor may be oriented relative to a datum on the device, which may be a scribe line, and the method may comprise deploying the device into the wellbore in such a way that the orientation of the datum relative to north on a compass is known. In this way, the orientation of a feature whose presence is detected by the at least one magnetic field sensor can be determined, because the orientation of the sensor relative to the datum is known, and the orientation of the datum relative to north on a compass is known. Where the device is deployed into a deviated wellbore, the device may be deployed in such a way that the datum is aligned with a high side of the wellbore.

The method may comprise correlating the output from the at least one magnetic field sensor with the output from the at least one orientation sensor using a processor of the device. The method may comprise pre-programming the processor with data relating to the orientation of the datum on the device relative to north on a compass, so that the outputs from the magnetic field and orientation sensors can be correlated. The method may comprise pre-programming the processor with data relating to the orientation of the at least one magnetic field sensor relative to the datum. The method may comprise transmitting data relating to the depth and orientation of the feature to surface. Alternatively, the method may comprise transmitting data relating to the outputs to a processor provided at surface.

The method may comprise deploying the device into the well on a string of tubing, wireline or slickline. Deployment on tubing may be preferred as this may facilitate use in a deviated well. The device may comprise a plurality of magnetic field sensors, and the method may comprise correlating the outputs of all of the magnetic field sensors with the at least one orientation sensor. By correlating the output of a particular magnetic field sensor with the output of the at least one orientation sensor, a determination of the orientation of the feature detected by the magnetic field sensor (and to which the output pertains) can be achieved.

According to a fourth aspect of the present invention, there is provided a method of performing an operation in a wellbore containing a ferrous tubing, the method comprising the steps of:

- running a downhole apparatus comprising a device for determining the depth and orientation of a feature in a wellbore containing a ferrous tubing, and a device for performing an operation in the well which cooperates with the feature, through the tubing;
- monitoring the inherent magnetic field of the ferrous tubing using at least one magnetic field sensor of the device for determining the depth and orientation of the feature, to detect the presence of the feature;
- determining the orientation of the device within the wellbore using at least one orientation sensor of the device for determining the depth and orientation of the feature;
- determining the orientation of the feature detected by the at least one magnetic field sensor within the wellbore by correlating an output from the at least one magnetic field sensor with an output from the at least one orientation sensor; and
- following determination of the depth and orientation of the feature, arranging the device for performing the operation to cooperate with the feature so as to perform the downhole operation.

The method may comprise determining the shape of the feature. The feature may be a profile in the wellbore. The profile may be a window formed in the ferrous tubing, which may be a window of a lateral well. Correlation of the output from the at least one magnetic field sensor with that of the at least one orientation sensor may facilitate the determination of data about the shape of the feature. For example, where the feature is a profile such as a window, a circumferential width of the window will typically change along a length of the wellbore. The method may involve determination of the shape of the window by assessing the change in circumferential width of the window, by monitoring changes in the quantity of ferrous material as the device passes along the wellbore.

Once the depth and orientation of the window has been determined, the downhole operation may be carried out. The method may involve positioning a packer in the lateral wellbore, to close off flow into the main wellbore. A deflection tool may be run on wireline down the inside of tubing which is used to run the device into and along the wellbore, and used to deflect the packer into the lateral wellbore. The orientation and/or inclination of the lateral wellbore may be verified against expected parameters using the orientation/inclination sensor.

Alternatively an assembly comprising the device, a lateral wellbore packer and a bent sub may be run-in to the main wellbore. Following determination of the depth and orientation of the desired window, an end of the bent sub may be placed adjacent the window and the bent sub end directed into the window. In this way, the packer and device can be directed into the lateral wellbore, guided by the bent sub. The orientation and/or inclination of the lateral wellbore may be verified against expected parameters using the orientation/inclination sensor. The packer can then be activated to close the lateral wellbore. The device can then be recovered to surface, leaving the packer and bent sub in the lateral wellbore. The present invention advantageously permits this operation to be carried out in a single run.

In an alternative, an assembly comprising a deflection tool may be run-in to the main wellbore, the deflection tool set in the main wellbore and employed to deflect the packer and device into the lateral wellbore. The packer and device may be released from the deflection tool for direction into the lateral wellbore. The orientation and/or inclination of the lateral wellbore may be verified against expected parameters using the orientation/inclination sensor. The packer may then can be set and the device released from the packer. The device may be used to retrieve the deflection tool from the main wellbore. This may avoid the need for a further run into the wellbore to retrieve the deflection tool. However, it may be desirable to recover the device to surface and then retrieve the deflection tool.

Further features of the method of performing an operation in a wellbore are defined above in relation to the third aspect of the invention, or may be derived from or with respect to either of the first or second aspects of the invention.

Embodiments of the present invention will now be described, with reference to the accompanying drawings, in which.

Figure 1:
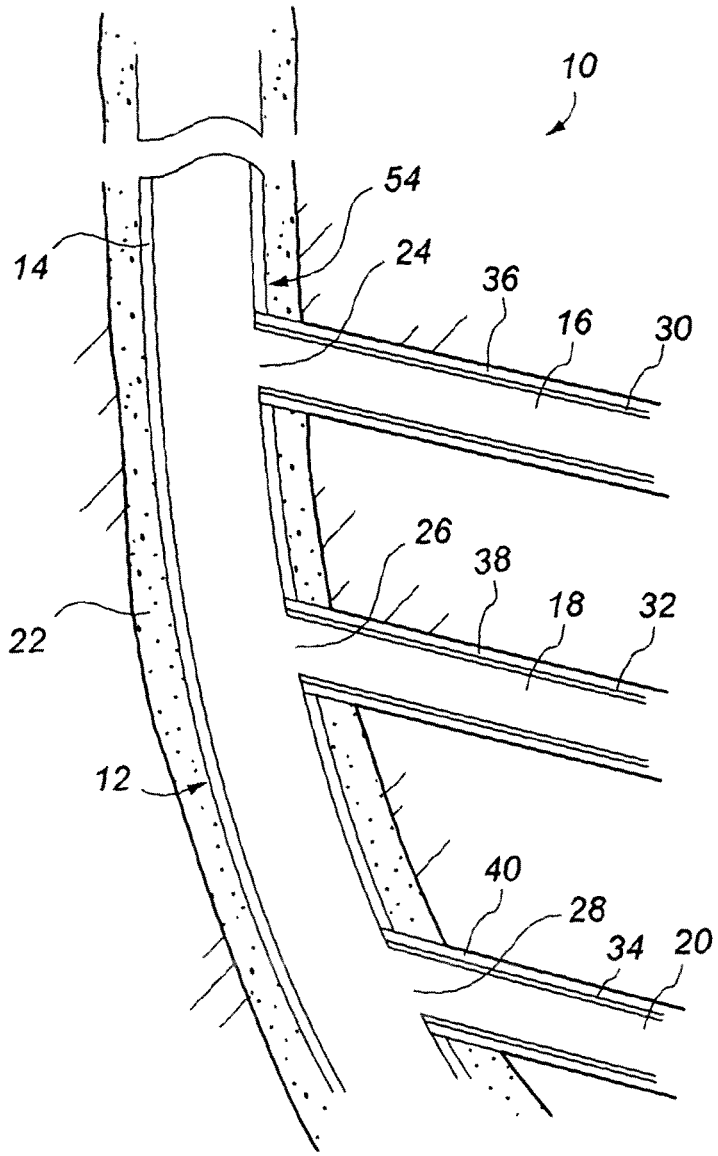
FIG. 1 is a schematic longitudinal sectional view of a multi-lateral well system.
Figure 3:
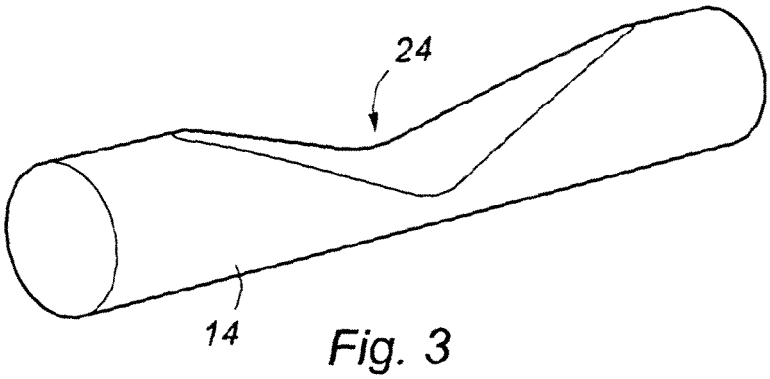
FIG. 3 is a perspective view of the window shown in FIG. 2.
Figure 11:
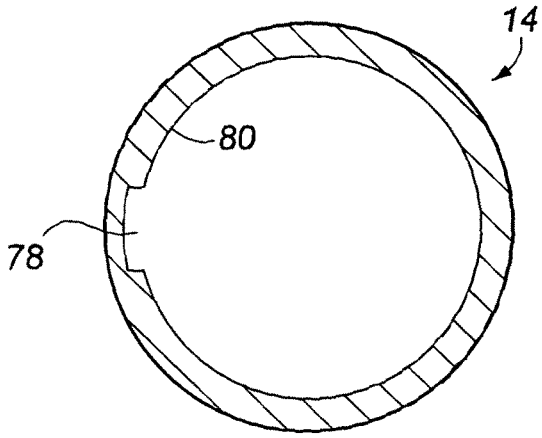
Figure 12:
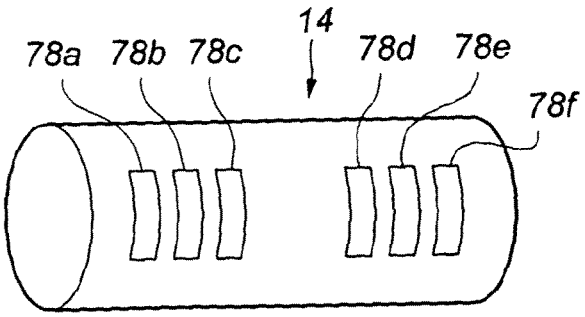
Figure 10:
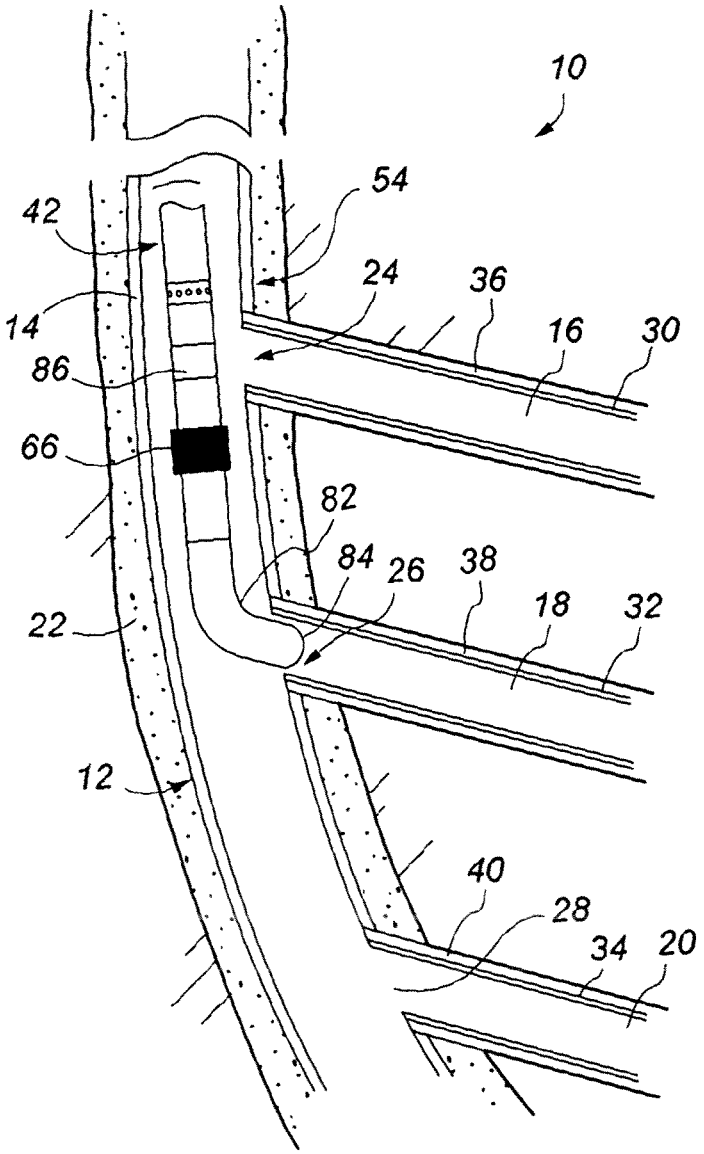
FIG. 10 is a highly schematic view illustrating another method of positioning a packer in one of the lateral wellbores shown in FIG. 1.

FIG. 11 (presented on the same page as FIG. 3) is a view of an alternative downhole feature in the form of a recess formed in an internal wall of the casing of FIG. 1; and FIG. 12 (presented on the same page as FIG. 3) is a schematic perspective view of a variation on FIG. 10 in which there are a number of axially spaced recesses.

Figure 2:
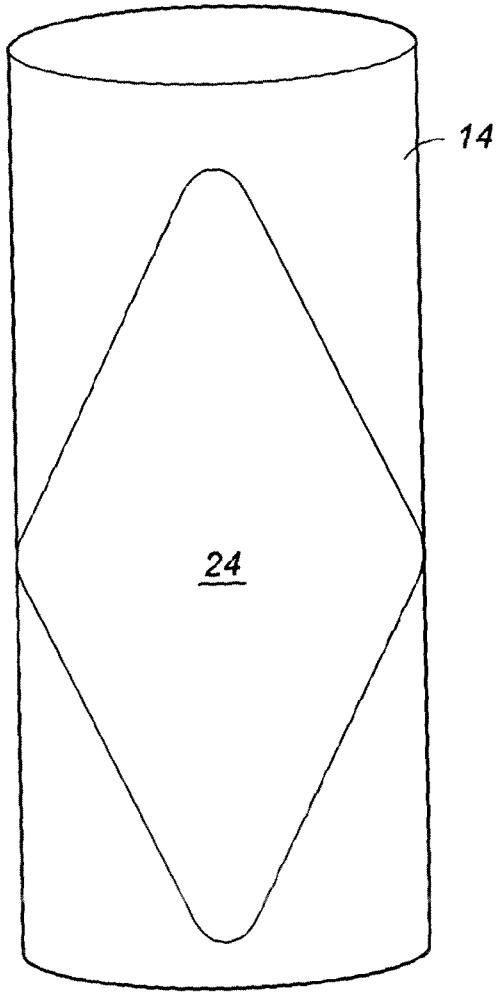
FIG. 2 is an enlarged view of a window in a wellbore-lining tubing in a main wellbore of the multi-lateral system of FIG. 1, viewed from the right in FIG. 1.

Turning firstly to FIG. 1, there is shown a schematic longitudinal sectional view of a multi-lateral well system indicated generally by reference numeral 10, and which comprises a deviated main wellbore or borehole 12 which has been drilled from surface and lined with a wellbore-lining tubing in the form of a casing 14. The casing 14 has been installed in the main wellbore 12 and cemented in place, as indicated at 22 in the drawing. A number of lateral wellbores have been drilled from the main wellbore 12, and three such laterals 16, 18 and 20 are shown in the drawing. The lateral wellbores 16, 18 and 20 are spaced along the length of the casing 14, and may also be spaced around the circumference of the casing, and so at different orientations (or azimuths). The lateral wellbores 16, 18 and 20 have been formed in a conventional fashion, employing a deflection tool known as a whipstock (not shown). The whipstock is positioned in the casing 14, and has a hardened surface which deflects a drilling or milling tool laterally outward through a wall of the casing. In this way, a number of windows 24, 26 and 28 are formed in the casing 14. One of these windows, namely the window 24, is shown in more detail in the enlarged view of FIG. 2 which is viewed from the right in FIG. 1, and also in FIG. 3, which is a perspective view.

The lateral wellbores 16, 18 and 20 extend from the main wellbore 12 to lateral wells (not shown) which are displaced laterally from the main wellbore. Wellbore lining tubing in the form of liners 30, 32 and 34 can be located in the lateral wellbores and cemented in place at 36, 38 and 40, as shown in the drawing. The casing 14, and indeed the liners 30, 32 and 34, are ferrous and so magnetic, and as such all have inherent magnetic fields. However and as will be understood by persons skilled in the art, one or more of the lateral wellbores 16, 18 and 20 may be open-hole completions in which no wellbore-lining tubing is installed in the drilled lateral wellbore. The present invention seeks to utilise the inherent magnetic field of the casing 14 for subsequent determination of the depth and orientation of the windows 24, 26 and 28 which, in the context of the present invention, are features, in particular profiles, in the main wellbore 12.

Figure 4:
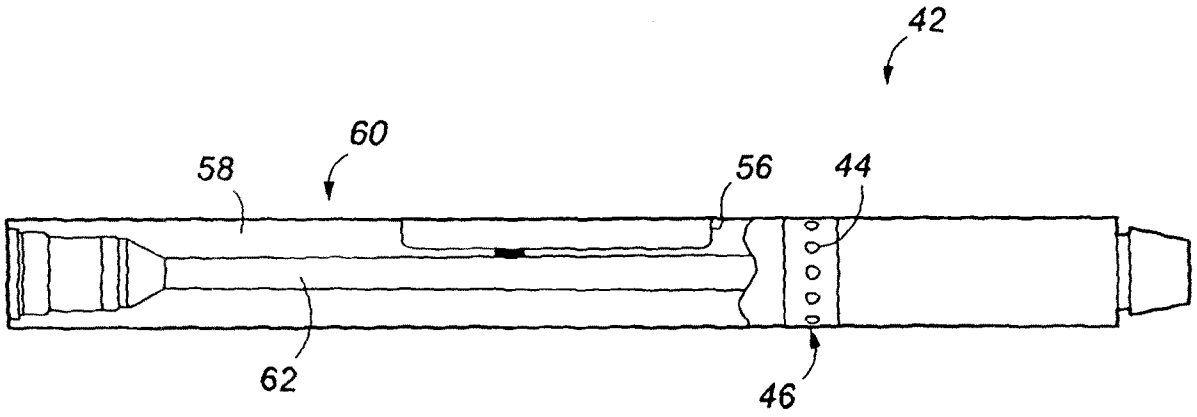
FIG. 4 is a partial longitudinal sectional view of a downhole device for determining the depth and orientation of a feature in a wellbore containing a ferrous tubing, in accordance with an embodiment of the present invention.

The invention will now be described. Turning to FIG. 4, there is shown a partial longitudinal sectional view of a downhole device for determining the depth and orientation of a feature in a wellbore containing a ferrous tubing, the device indicated generally by reference numeral 42. The device 42 is also shown in the enlarged perspective view of FIG. 5. In this example, the ferrous tubing is the casing 14 shown in FIG. 1. The device 42 generally comprises at least one magnetic field sensor and, in the illustrated embodiment, comprises a plurality of such sensors 44. The sensors 44 are for monitoring the inherent magnetic field of the ferrous casing 14, so that the presence of a feature in the wellbore 12 can be detected. In this instance and as discussed above, the feature is one (or more) of the lateral windows 24, 26 and 28.

The sensors 44 are arranged in an array 46 extending around a perimeter of the device 42. The sensors 44 are passive sensors which can detect the inherent magnetic field of the casing 14 as the device 42 travels along the wellbore 12. Such sensors are readily commercially available, and comprise a coil (or coils) in which an electrical current is induced when the coil moves through the casing 14 magnetic field. The magnetic field sensors 44 therefore generate an electrical output which varies depending upon the strength of the magnetic field detected by the sensors. In particular, removal of material from the wall of the casing 14 during formation of the windows 24, 26 and 28 affects the magnetic field locally in the vicinity of the windows. Specifically, the magnetic field in the region of the casing 14 in which the windows are formed is weaker at the window than around a circumference of the casing where metal remains. This absence of material, and so weaker magnetic field, is detected by the magnetic sensors 44 when the device 42 travels along the wellbore 12. The reduction is felt most strongly by the sensors 44 which are proximate to the window 24, 26 or 28.

The device 42 also comprises at least one orientation sensor for determining the orientation of the device within the wellbore and, in the illustrated embodiment, comprises one such sensor 48. Any desired number of orientation sensors 48 may, however, be provided. The outputs from the magnetic field sensors 44 are correlated with the output from the orientation sensor 48, so that the orientation of the window 24, 26 or 28 detected by the at least one magnetic field sensor within the wellbore 12 can be determined. The orientation sensor typically takes the form of a magnetometer or gyroscopic sensor. Such sensors are again readily commercially available. The device 42 also comprises an inclinometer 49 which can measure inclination. This may facilitate determination that a lateral wellbore 16, 18, 20 has been correctly entered, in that feedback on the inclination of the wellbore (which is known) can be obtained.

Figure 5:
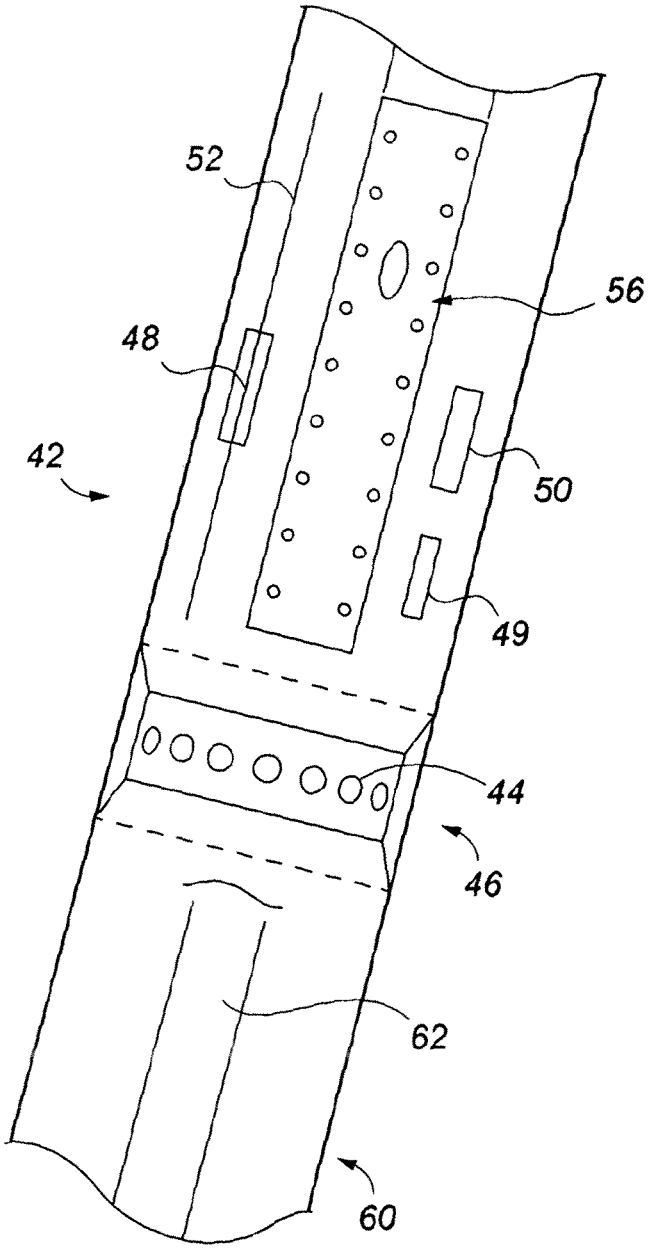
FIG. 5 is an enlarged perspective view of the device shown in FIG. 4.

The device 42 also comprises a processor 50 for correlating the output from the magnetic field sensors 44 with the output from the orientation sensor 48. Correlation of the outputs is achieved as follows. The magnetic field sensors 44 are oriented relative to a datum on the device, which in the illustrated embodiment is a scribe line 52 (FIG. 5). The device 42 is deployed into the wellbore 12 in such a way that the orientation of the scribe line 52 relative to north on a compass is known. In this way, the orientation of a window 24, 26 or 28 whose presence is detected by the magnetic field sensors 44 can be determined. This is because the orientation of the sensors 44 relative to the scribe line 52 is known, and the orientation of the scribe line 52 relative to north on a compass is known. The device 42 is deployed into the deviated wellbore 12 in such a way that the scribe line 52, which defines a 'tool-face' of the device, is aligned with a high side 54 of the wellbore (FIG. 1). The high side is the portion of the deviated wellbore 12 which is closer to the surface.

The processor 50 receives the outputs from the magnetic fields sensors 44 and the orientation sensor 48, and is pre-programmed with the data concerning the orientation of the scribe line in the wellbore 12, and the orientations of the magnetic field sensors 44 relative to the scribe line. In this way and employing suitable software which is readily commercially available, the processor 50 can be arranged to determine the orientation (azimuth) of the magnetic field sensor 44 outputting a particular field strength measurement. A magnetic field sensor 44 closest to and so facing the window 24, 26 or 28 will detect a much lower magnetic field than one which is furthest away from the window and so facing a wall of the casing 14. Outputs from all of the magnetic field sensors 44 can therefore be processed to obtain data concerning the orientation of the window 24, 26 or 28 which is detected.

As to the depth of the window 24, 26 or 28 which is detected, the depth is determined as follows. The device 42 can deployed into the well on a string of tubing, or alternatively wireline or slickline (not shown). Deployment on tubing may, however, be preferred as this may facilitate use in a deviated well such as that shown in FIG. 1. The depth of the device in the wellbore is known, as the length of the tubing, wireline or slickline deployed into the well is known. The depth of a window 24, 26 or 28 detected by the magnetic field sensors 44 can therefore be determined by correlating the length of tubing, wireline or slickline deployed into the wellbore 12 with data relating to the detection of the window. For example, when one of the magnetic field sensors 44 first detects a reduction in the magnetic field, this is indicative of the sensor in question having reached the window 24, 26 or 28 in question, where ferrous material has been removed from the casing 14 wall.

Figure 6:
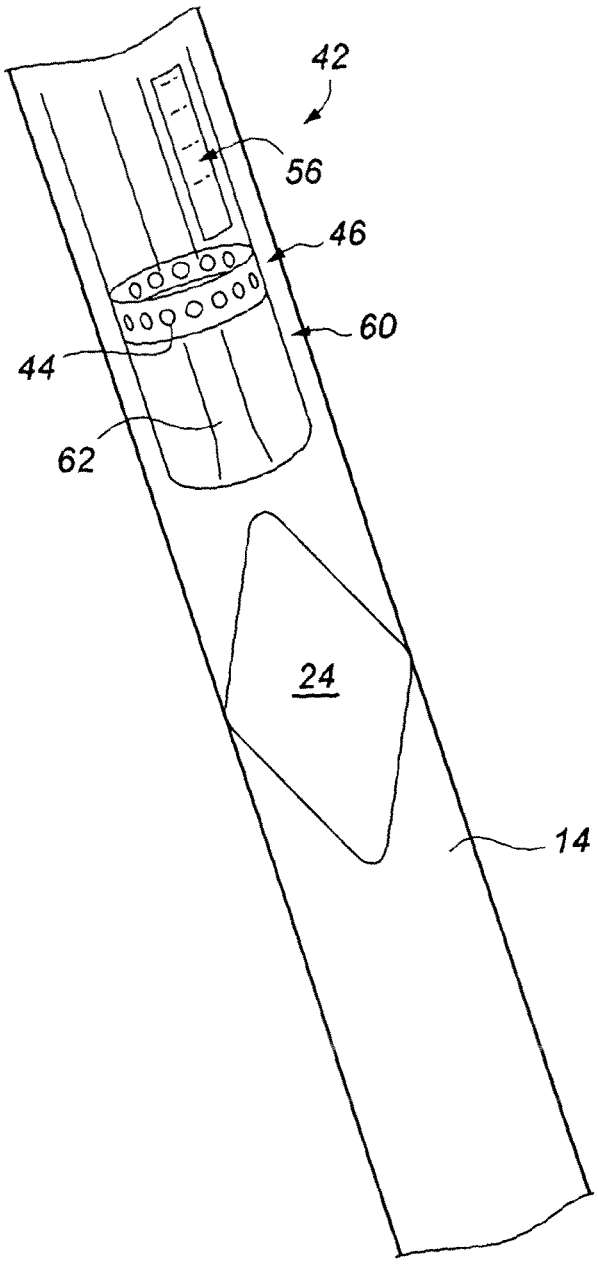
FIG. 6 is a view showing the device of FIG. 4 during run-in to the wellbore of FIG. 1, located at a position which is uphole of a window.
Figure 7:
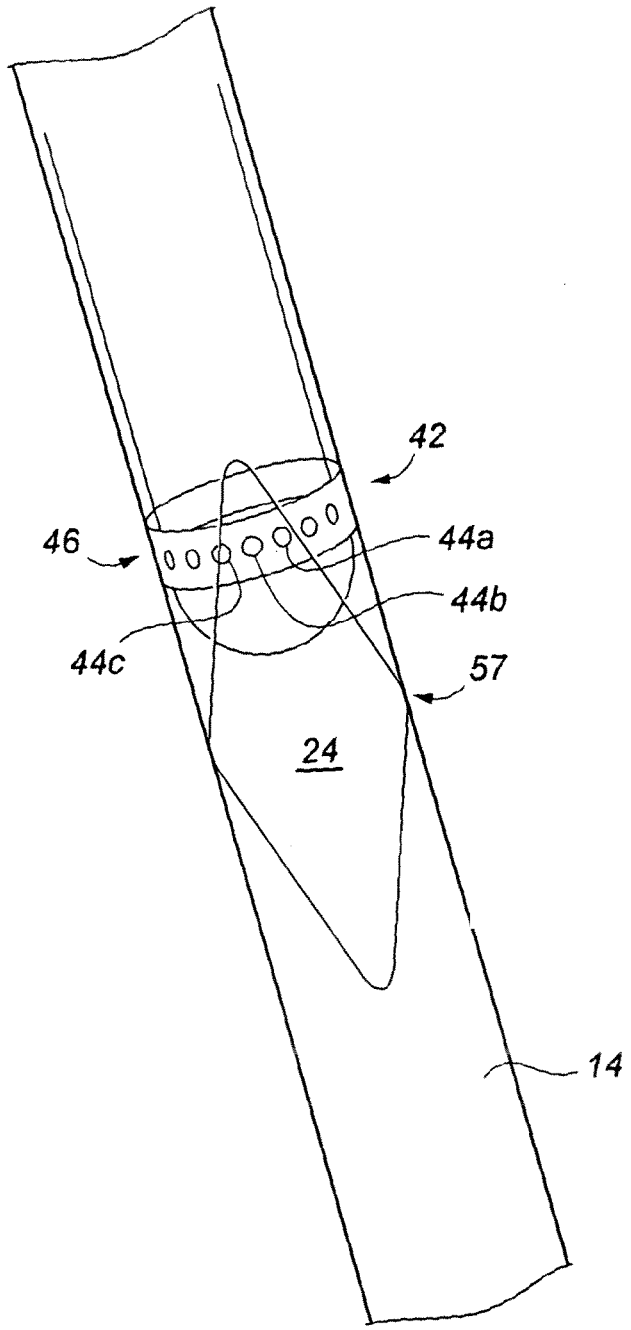
FIG. 7 is a view similar to FIG. 6, showing the device further downhole.
Figure 8:
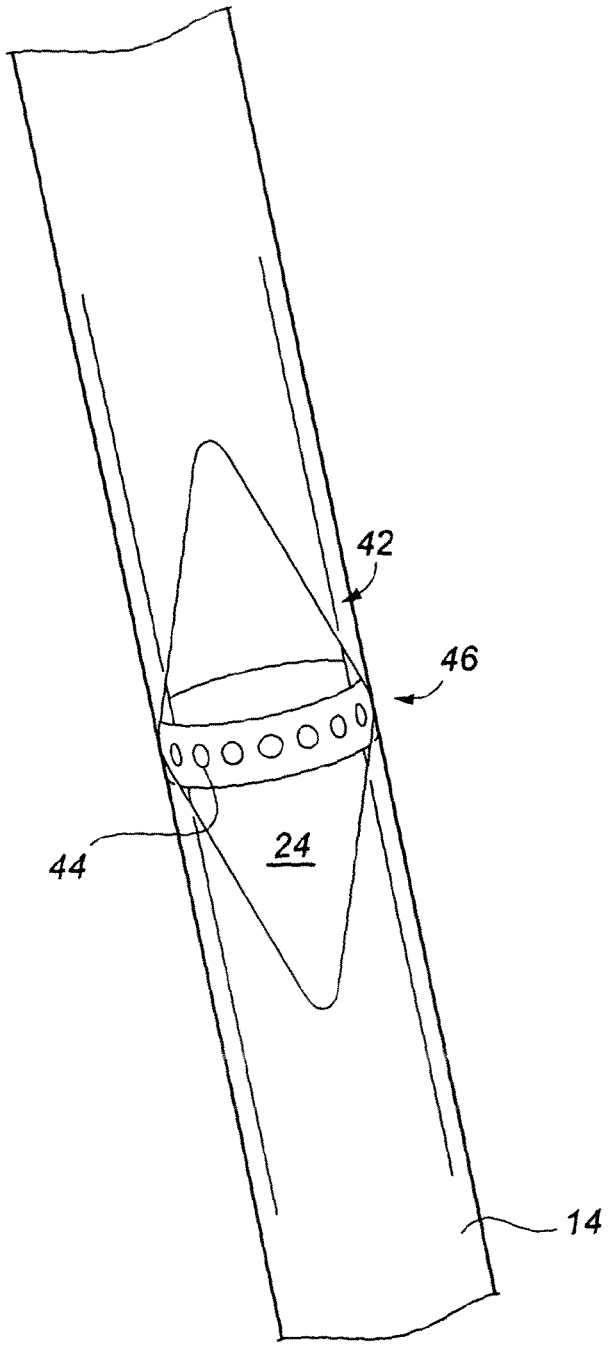
FIG. 8 is a view similar to FIG. 6, showing the device still further downhole and located at a mid-point of the window.

Correlation of the output from the magnetic field sensors 44 with that of the orientation sensor 48 also facilitates the determination of data about the shape of the window 24, 26 or 28. This is because a circumferential width of the window 24, 26, 28 changes along a length of the wellbore 12. The device 42 facilitates the determination of the shape of the window in that it is capable of distinguishing the change in circumferential width, owing to the changes in the quantity of ferrous material detected. This is illustrated in FIGS. 6 to 8. In FIG. 6, the device is shown during run-in to the wellbore 12, located at a position which is uphole of the window 24. At this time, the magnetic field sensors 44 detect a full strength magnetic field of the ferrous casing 14. FIG. 7 shows the device 42 further downhole, where two of the magnetic field sensors 44*a* and 44*b* face the window 24 and so detect a significantly reduced magnetic field, due to the lack of ferrous material. A further sensor 44*c* overlaps an edge 55 of the window 24, and so detects a magnetic field which is reduced but not as low as that detected by the sensors 44*a* and 44*b*. FIG. 8 shows the device 42 located at a mid-point 57 of the window 24 of maximum width, where many more of the magnetic field sensors 44 detect reduced magnetic fields.

The processor 50 is arranged to transmit data relating to the depth and orientation of the window 24, 26 or 28 to surface. To this end, the device 42 comprises a communication arrangement 56 for transmitting data to surface, which data may relate to the depth and/or orientation of a window 24, 26 or 28. The communication arrangement 56 is capable of transmitting data to surface real-time, to provide feedback relating to the position of the device within the wellbore, and so the depth and orientation of the window 24, 26 or 28. As will be described below, this facilitates subsequent performance of a downhole operation. In the illustrated embodiment, the communication arrangement is fluid operated and takes the form of a fluid pressure pulse generator 56 for transmitting fluid pressure pulses representative of the data to surface. One such suitable fluid pulse generator is disclosed in the present applicant's International Patent Publication No. WO-2011/004180, the disclosure of which is incorporated herein by way of reference. The pulse generator 56 is located in a wall 58 of a main body 60 of the device 42, so that is does not restrict a main bore 62 of the device.

Figure 9:
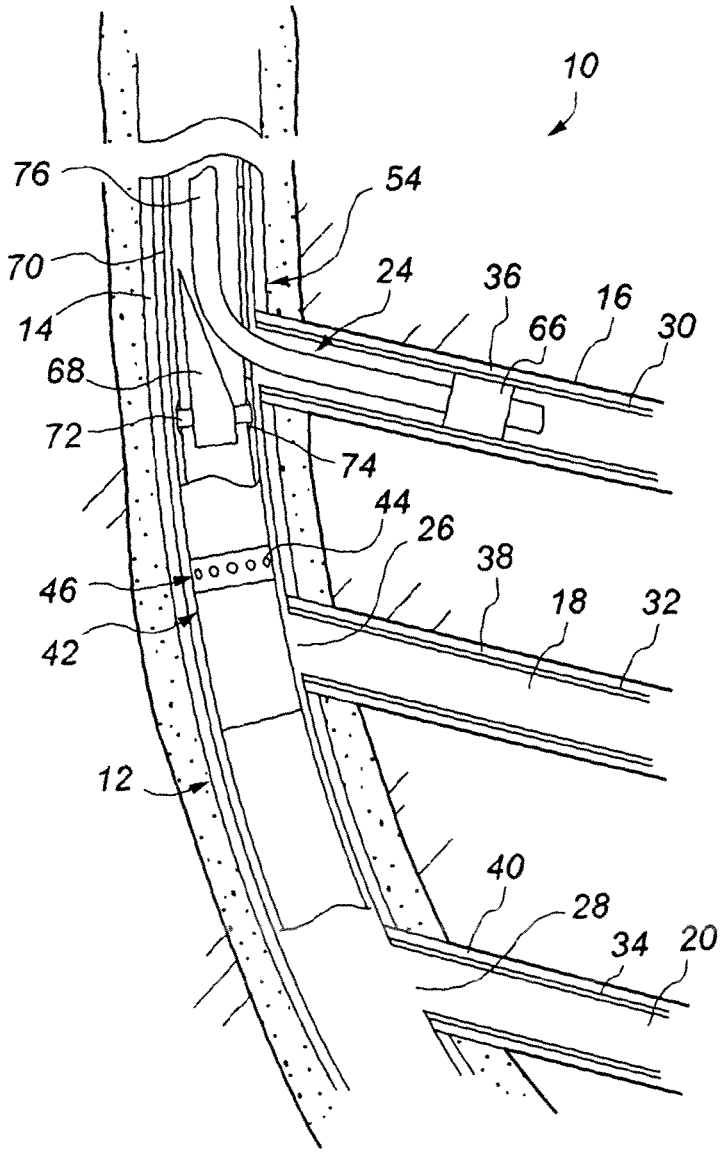
FIG. 9 is a highly schematic view illustrating the positioning of a packer in one of the lateral wellbores shown in FIG. 1.

Once the depth and orientation of a window 24, 26 or 28 has been determined, and confirmation obtained that it is the correct window, the required downhole operation may be carried out. In the illustrated embodiment, the lateral well which communicates with the main wellbore 12 through the lateral wellbore 16 has started to produce water. The downhole operation involves positioning a packer in the liner 30 located in the lateral wellbore 16, to close off flow into the main wellbore 12. FIG. 9 illustrates, in highly schematic fashion, the positioning of a packer 66 in the lateral wellbore 16. Following determination of the depth and orientation of the window 24, a deflection tool 68 is run on wireline (not shown) down the inside of tubing 70 which is used to run the device 42 into and along the wellbore 12. The deflection tool carries locking dogs 72 which latch out into a recess 74 in the wall of the tubing 70. The position of the recess 74 relative to the magnetic field sensors 44 is known, so that the deflection tool is properly spaced out, and so positioned for deflecting the packer 66 into the lateral wellbore 16. The packer 66 is then run down on a tool string 76 and deflected into the lateral wellbore 16. The orientation of the lateral wellbore 16 is verified against expected parameters using the orientation sensor 48, and the inclination similarly verified using the inclinometer 50. The packer 66 can then be set, and the tool string 76 and deflection tool 68 retrieved. Advantageously, the device 42 can be retained within the wellbore 12, and so does not require to be returned to surface in order for the packer 66 to be deployed into the lateral wellbore 16 and set.

Turning now to FIG. 10, there is shown an alternative method of entering one of the lateral wellbores, in this instance the lateral wellbore 18. An assembly comprising the device 42, lateral wellbore packer 66 and a bent sub 82, of a type known in the art, is run-in to the wellbore 12. The device 42 is employed to determine the location of the window 26, in the fashion described above. The device 42 is then pulled back uphole to position an end 84 of the bent sub 82 adjacent the window 26. The location of the bent sub end 84 relative to the the device 42 is known, so that the bent sub 82 can be positioned with its end 84 adjacent the window 26. By appropriate manipulation of a string of tubing carrying the assembly, the bent sub end 84 can then be directed into the window 26. In this way, the packer 66 and device 42 can be directed into the lateral wellbore 18, guided by the bent sub 82. The orientation and inclination of the lateral wellbore 18 can then be verified against expected parameters, to ensure that the correct lateral wellbore has been entered. The packer 66 can then be activated to close the lateral wellbore 18. A hydraulic release tool 86, which connects the device 42 to the packer 66, can then be actuated to release the device 42 for recovery to surface, leaving the packer 66 and bent sub 82 in the lateral wellbore 18. The present invention advantageously permits this operation to be carried out in a single run, the equipment which is required to deflect the packer 66 into the lateral wellbore 18, and to position and activate the packer, being run together with the device 42.

In a variation (not shown) on the assembly shown and described in FIG. 10, an assembly may be provided in which the bent sub 82 is replaced with a deflection tool that can be set in the main wellbore 12 and employed to deflect the packer 66 and device 42 into the lateral wellbore 18. The deflection tool is of a type known in the industry, and is connected to the packer 66 via a hydraulic release tool, similar to the tool 86 of FIG. 10. Following identification of the window 26, the deflection tool can be set in the main wellbore 12 using a suitable packer, and the hydraulic release tool actuated to release the packer 66 and device 42 from the deflection tool. The packer 66 and device 42 can then be directed into the lateral wellbore 18, using the deflection tool, in a similar fashion to that described above in relation to FIG. 9. Following verification of the lateral wellbore orientation and inclination, the packer 66 can be set, and the device 42 released from the packer. The device 42 can be adapted so that it can retrieve the deflection tool from the main wellbore 12, avoiding the need for a further run into the wellbore to retrieve the deflection tool. However, it may be desirable to recover the device 42 to surface and then retrieve the deflection tool.

Whilst the device 42 of the present invention is described above and shown in FIGS. 1 to 9 during the determination of the depth and orientation of a feature which is a profile in the form of a window 24, 26 and 28, the device may have a utility in determining depth/orientation of a wide range of different downhole features. For example and as shown in the cross-sectional view of FIG. 11, the feature may be a profile in the form of a recess, groove or channel 78 formed in an internal wall 80 of the ferrous casing. The recess 78 may define a latch profile for receiving a latch element (not shown) that is to be engaged with the latch profile, which may serve for locating a downhole tool in the casing 14 so that the tool can perform a desired operation. FIG. 12 is a schematic perspective view of a further variation in which there are a number of axially spaced recesses 78*a* to 78*f*, whose depth and orientation can be determined using the device 42. The feature may alternatively be a body (not shown) having an inherent magnetic field which is less than that of a material of the ferrous casing 14, or which may be non-ferrous or non-magnetic, or which may have a negligible inherent magnetic field. The body may be a tubular component and may be a pipe or sleeve or the like positioned within and/or coupled to the ferrous casing 14. Different lengths of non or reduced-magnetic field strength pipes may be employed to identify certain sections of the wellbore 12.

The present invention provides numerous advantages, some of which are discussed above. It can permit the shape, the location (depth) and the orientation (toolface) of a profile within a main wellbore or borehole to be determined. This can be achieved in a rapid and convenient and inexpensive way. The location and the orientation of a feature, particularly a window, can be determined in the same run as equipment being placed into the well such as into a lateral wellbore. The inclination and azimuth of a lateral wellbore can also be determined in real-time to validate the correct lateral has been entered.

Various modifications may be made to the foregoing without departing from the spirit or scope of the present invention.

For example, at least one magnetic field sensor may be spaced axially along a length of the device from at least one other sensor. The device may comprise a plurality of arrays of magnetic field sensors, each array comprising a plurality of magnetic field sensors. Each array may be spaced axially along a length of the device from at least one other array. Each array may be spaced around a periphery of the device from at least one other array.

The ferrous tubing may be one of a range of different types of tubing employed in the oil and gas exploration industry and which can be deployed downhole in a wellbore, and which may comprise but is not limited to wellbore-lining tubing (casing, liner), coiled tubing, production tubing, or a string of tubing for deploying a tool or assembly in a well.

The device may be arranged to transmit data relating to the outputs to a processor provided at surface. The communication arrangement may be electrically operated, and may transmit data to surface along a communication cable extending to surface, along the ferrous tubing or another tubing in the wellbore. Other communication arrangements may be employed, such as acoustic or radio frequency communication arrangements.

The invention claimed is:

1. A downhole device comprising:

at least one magnetic field sensor that detects an inherent magnetic field of a ferrous tubing contained in a wellbore;

at least one orientation sensor that determines an orientation of the device within the wellbore; and a processor that receives and correlates an output from the at least one magnetic field sensor and an output from the at least one orientation sensor to determine an orientation of a feature of the ferrous tubing, the feature having an inherent magnetic field different than the inherent magnetic field of the ferrous tubing, wherein the feature is a window formed in the ferrous tubing and has a circumferential width that changes along a length of the wellbore, and wherein, to facilitate determination of the shape of the window, the processor determines changes in circumferential width of the window based on changes in the detected inherent magnetic field across the window.

2. The device of claim 1, wherein the at least one magnetic field sensor is a passive magnetic field sensor.

3. The device of claim 1 further comprising a plurality of magnetic field sensors spaced around a periphery of the downhole device.

4. The device of claim 1 further comprising a plurality of arrays of a plurality of magnetic field sensors, each array being spaced axially along a length of the device from at least one other array and/or each array being spaced around a periphery of the device from at least one other array.

5. The device of claim 1 further comprising at least one sensor for measuring inclination.

6. The device of claim 1, wherein the processor further correlates the output from the at least one magnetic field sensor with the output from the at least one orientation sensor to determine a shape of the feature.

7. The device of claim 1 further comprising a datum such that an orientation of the datum relative to north on a compass is known, wherein the at least one magnetic field sensor is oriented relative to the datum.

8. The device of claim 7, wherein the processor is pre-programmed with data relating to the orientation of the datum.

9. The device of claim 8, wherein the processor further correlates the output from the at least one magnetic field sensor with the output from the at least one orientation sensor to determine an orientation of the feature relative to the datum.

10. The device of claim 1 further comprising a communication arrangement for transmitting data to surface relating to the orientation of the feature in real-time.

11. A method of determining the depth, shape, and orientation of a window in a wellbore containing a ferrous tubing, the method comprising the steps of:

running a downhole device comprising at least one magnetic field sensor, at least one orientation sensor, and a processor through the ferrous tubing in a wellbore;

monitoring an inherent magnetic field of the ferrous tubing using the at least one magnetic field sensor;

observing a window of the ferrous tubing, the window having an inherent magnetic field different than the inherent magnetic field of the ferrous tubing;

determining an orientation of the downhole device within the wellbore using the at least one orientation sensor;

determining an orientation of the window by correlating an output from the at least one magnetic field sensor with an output from the at least one orientation sensor using the processor; and determining a shape of the window by determining changes in the circumferential width of the window based on changes in the monitored inherent magnetic field across the window.

12. The method of claim 11 further comprising determining a shape of the window by correlating the output from the at least one magnetic field sensor with that of the at least one orientation sensor.

13. The method of claim 11 further comprising orienting the at least one magnetic field sensor relative to a datum on the downhole device; and deploying the device into the wellbore with a known orientation of the datum relative to north on a compass.

14. The method of claim 13, wherein the wellbore is deviated, and the method further comprises deploying the device in such a way that the datum is aligned with a high side of the wellbore.

15. The method of claim 13 further comprising pre-programming the processor with data relating to the orientation of the datum relative to north on a compass.

16. The method of claim 15 further comprising pre-programming the processor with data relating to the orientation of the at least one magnetic field sensor relative to the datum.

17. The method of claim 11 further comprising transmitting data relating to a depth of the downhole device and the orientation of the window to surface in real-time.

18. The method of claim 11, wherein the device comprises a plurality of magnetic field sensors, and the method comprises correlating outputs of all of the magnetic field sensors with the at least one orientation sensor.

19. A downhole device comprising:

a plurality of magnetic field sensors spaced around a periphery of the downhole device that detect an inherent magnetic field of a ferrous tubing contained in a wellbore;

at least one orientation sensor that determines an orientation of the device within the wellbore;

a processor that receives and correlates an output from the at least one magnetic field sensor and an output from the at least one orientation sensor to determine an orientation and a shape of a window of the ferrous tubing, the window having an inherent magnetic field different than the inherent magnetic field of the ferrous tubing, wherein the inherent magnetic field of the window changes along a length of the wellbore due to changes of circumferential width of the window along the length of the wellbore, the shape of the window being determined based on detection, by the plurality of magnetic field sensors, of the changes in the inherent magnetic field of the window along the length of the wellbore; and a communication arrangement for transmitting data to surface relating to the orientation of the window in real-time.

* * * * *